US006658982B2

(12) United States Patent
Cherry

(10) Patent No.: US 6,658,982 B2
(45) Date of Patent: Dec. 9, 2003

(54) COCKING KNOB AND STRIKER ARRANGEMENT FOR GAS-POWERED PROJECTILE FIRING DEVICE

(75) Inventor: Steven R. Cherry, Bentonville, AR (US)

(73) Assignee: Brass Eagle, Inc., Bentonville, AR (US)

( * ) Notice: Subject to any disclaimer, the term of this patent is extended or adjusted under 35 U.S.C. 154(b) by 0 days.

(21) Appl. No.: 10/103,574

(22) Filed: Mar. 22, 2002

(65) Prior Publication Data

US 2003/0178018 A1 Sep. 25, 2003

(51) Int. Cl.[7] ..... F41A 3/72
(52) U.S. Cl. ..... 89/1.42; 124/76
(58) Field of Search ..... 124/76, 73; 89/1.42; 42/16

(56) References Cited

U.S. PATENT DOCUMENTS 1,328,356 A * 1/1920 Ballard ..... 89/33.25
3,456,375 A * 7/1969 Badali et al. ..... 42/16
5,063,905 A * 11/1991 Farrell ..... 124/72
5,462,042 A * 10/1995 Greenwell ..... 124/76
6,019,024 A * 2/2000 Robinson et al. ..... 89/1.42

OTHER PUBLICATIONS

Brass Eagle Paintball Products, Model 1440 Owner's Manual, pp. 1–11 and Model 1440 Raptor Parts List (2 pages), published by Brass Eagle, Inc., Rogers, Arkansas, May 1998.

* cited by examiner

*Primary Examiner*—Charles T. Jordan
*Assistant Examiner*—John W. Zerr
(74) *Attorney, Agent, or Firm*—Foley & Lardner

(57) ABSTRACT

A cocking knob and striker assembly for a gas-powered projectile firing device (e.g., a paintball marker). The cocking knob is adapted for operative connection with the striker and has a rearwardly facing spring seat adapted to engage the striker spring. Spring pressure on the cocking knob keeps it engaged with the striker. The arrangement affords easier disassembly and reassembly of the parts.

39 Claims, 4 Drawing Sheets

COCKING KNOB AND STRIKER ARRANGEMENT FOR GAS-POWERED PROJECTILE FIRING DEVICE

BACKGROUND

This invention relates to gas-powered projectile firing devices, such as paintball markers, and in particular, to a cocking knob and striker arrangement for such devices.

Paintball markers typically are powered by a compressed gas, such as $CO_2$, which is released in a burst in the chamber behind a paintball to propel the paintball out of the barrel of the marker. The barrel is attached to a receiver that houses a bolt slidable in the chamber, a valve for controlling gas flow, and a spring-loaded striker that slides below the bolt. A trigger and sear assembly holds the striker in a rear, cocked position, and releases the striker when the trigger is pulled so that it moves forwardly under spring pressure to open the valve momentarily, releasing a metered quantity of gas into the chamber.

The striker and the bolt are linked together by a connecting pin so that they move in unison, the bolt serving to advance one paintball at a time from the breach, where paintballs are loaded through a ball feed port, into the chamber and seal the chamber from the feed port. A cocking handle or knob attached to the striker allows the user to pull the striker rearwardly to the cocked position, ready for firing. Most paintball markers are semi-automatic, i.e., gas pressure re-cocks the marker with each firing, so that manual cocking is required only when the gas supply is connected, and for the initial shot.

In prior art markers the cocking handle has a threaded end that screws into the striker, the other end of the handle projecting from the side of the marker and having a screwdriver slot for turning the cocking handle. The coil spring that drives the striker rests against the rear end of the striker, in some cases in a recess or a blind hole. When disassembling the marker for cleaning, there are many threaded connections that must be undone, the connection between the cocking handle and the striker being one such connection. Simplification of the disassembly and reassembly process is a desirable objective.

SUMMARY OF THE INVENTION

The invention accomplishes the aforementioned and other objectives by providing an improved cocking knob for moving the spring-loaded striker of a gas-powered projectile firing device rearwardly into a cocked position ready for firing. The cocking knob comprises an elongated member having a longitudinal axis, a proximal portion adapted for operative connection with the striker and a manually engageable distal portion, the proximal portion having a rearwardly facing spring seat adapted to engage the striker spring.

The spring seat preferably comprises a recess adapted to receive the front end of the striker spring. The spring seat recess may comprise a pair of spaced notches in which the front end of the striker spring can rest.

The proximal portion of the cocking knob preferably has a striker seat adapted to operatively engage the striker, the engagement of the striker spring and the spring seat serving to prevent disengagement of the striker seat from the striker. Conversely, disengagement of the striker spring from the spring seat affords easy disengagement of the cocking knob from the striker, without having to unscrew the cocking knob. The striker seat may comprise a generally J-shaped recess which opens generally axially and forwardly, the spring seat being disposed on the rear side of the longer leg of the J.

According to a second aspect, the invention provides a gas-powered projectile firing device comprising a receiver, a striker slidable in the receiver, a striker spring biasing the striker forwardly, and a cocking knob comprising an elongated member having a longitudinal axis, a proximal portion adapted for operative connection with the striker and a manually engageable distal portion, the proximal portion having a rearwardly facing spring seat adapted to engage the striker spring.

The proximal end of the cocking knob may have a J-shaped recess as described above that engages a substantially upright pin attached to the striker. The striker may have an axial bore at the rear end thereof and a lateral opening ahead of the rear end which opens into the axial bore, so that the proximal portion of the cocking knob extends through the lateral opening into the axial bore, and the striker spring extends forwardly into the axial bore to engage the spring seat on the proximal portion of the cocking knob.

According to a third aspect, the invention provides a gas-powered projectile firing device comprising a receiver; a chamber in the receiver; a bolt slidable in the chamber; a barrel at the front end of the receiver aligned with the chamber; a striker slidable in the receiver parallel to and below the chamber; a connecting pin interconnecting the striker and the bolt so that they move in unison; a valve assembly in the receiver forwardly of the striker; a striker spring in the receiver biasing the striker forwardly toward the valve assembly; a sear and trigger assembly for controlling the motion of the striker; and a cocking knob for moving the striker rearwardly into a cocked position ready for firing. The cocking knob comprises an elongated member having a longitudinal axis, a proximal portion engaging the connecting pin and a manually engageable distal portion, the proximal portion having a rearwardly facing spring seat which engages the forward end of the striker spring.

BRIEF DESCRIPTION OF THE DRAWING FIGURES

An embodiment that incorporates the best mode for carrying out the invention is described in detail below, purely by way of example, with reference to the accompanying drawing figures, in which.

Figure 1:
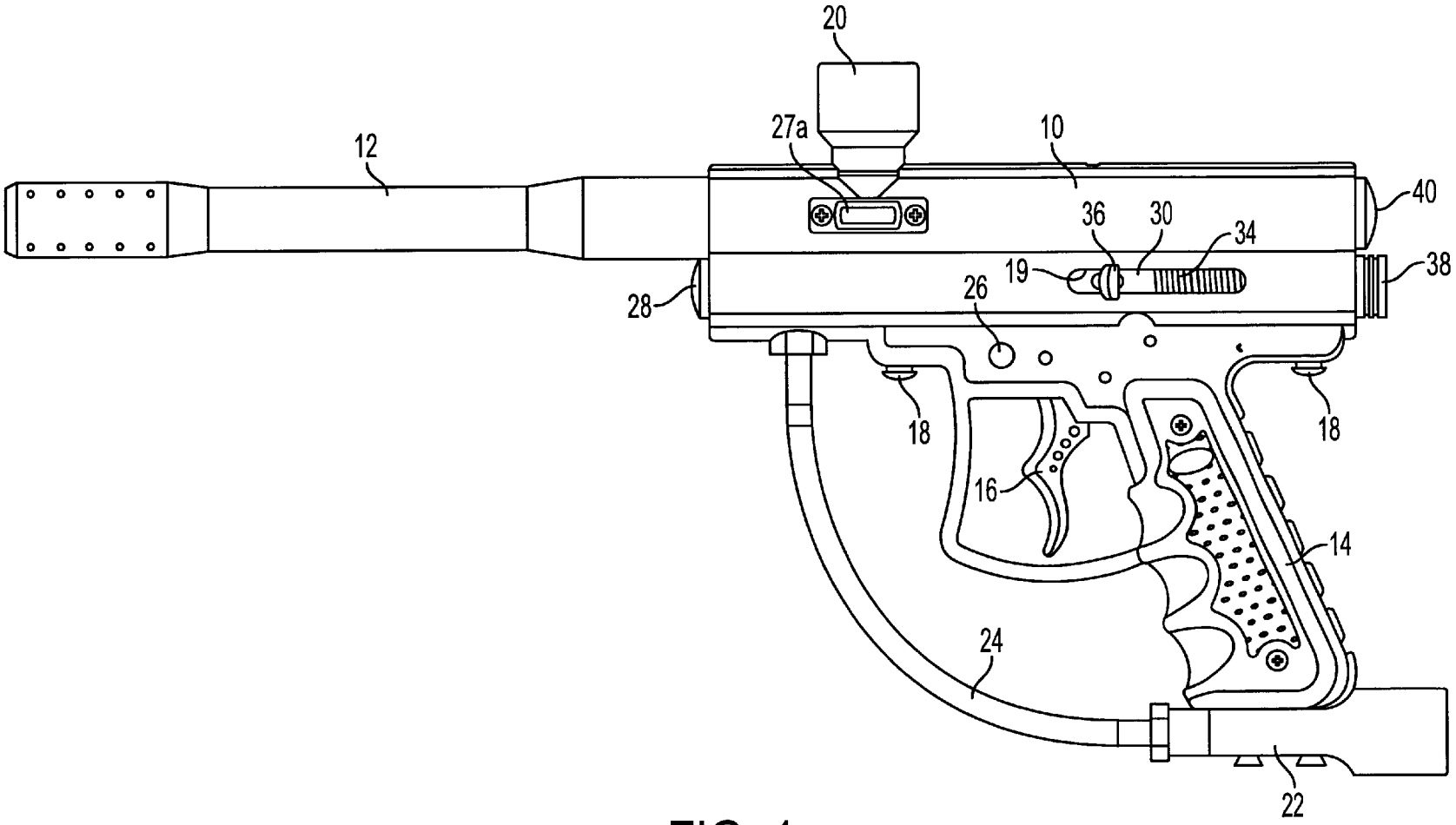
FIG. 1 is a side elevational view of a paintball marker incorporating the novel cocking knob and striker arrangement according to the invention.

It is to be understood that the invention is not limited in its application to the details of construction and the arrangement of components of the preferred embodiment described below or illustrated in the drawing figures.

DETAILED DESCRIPTION

Figure 2:
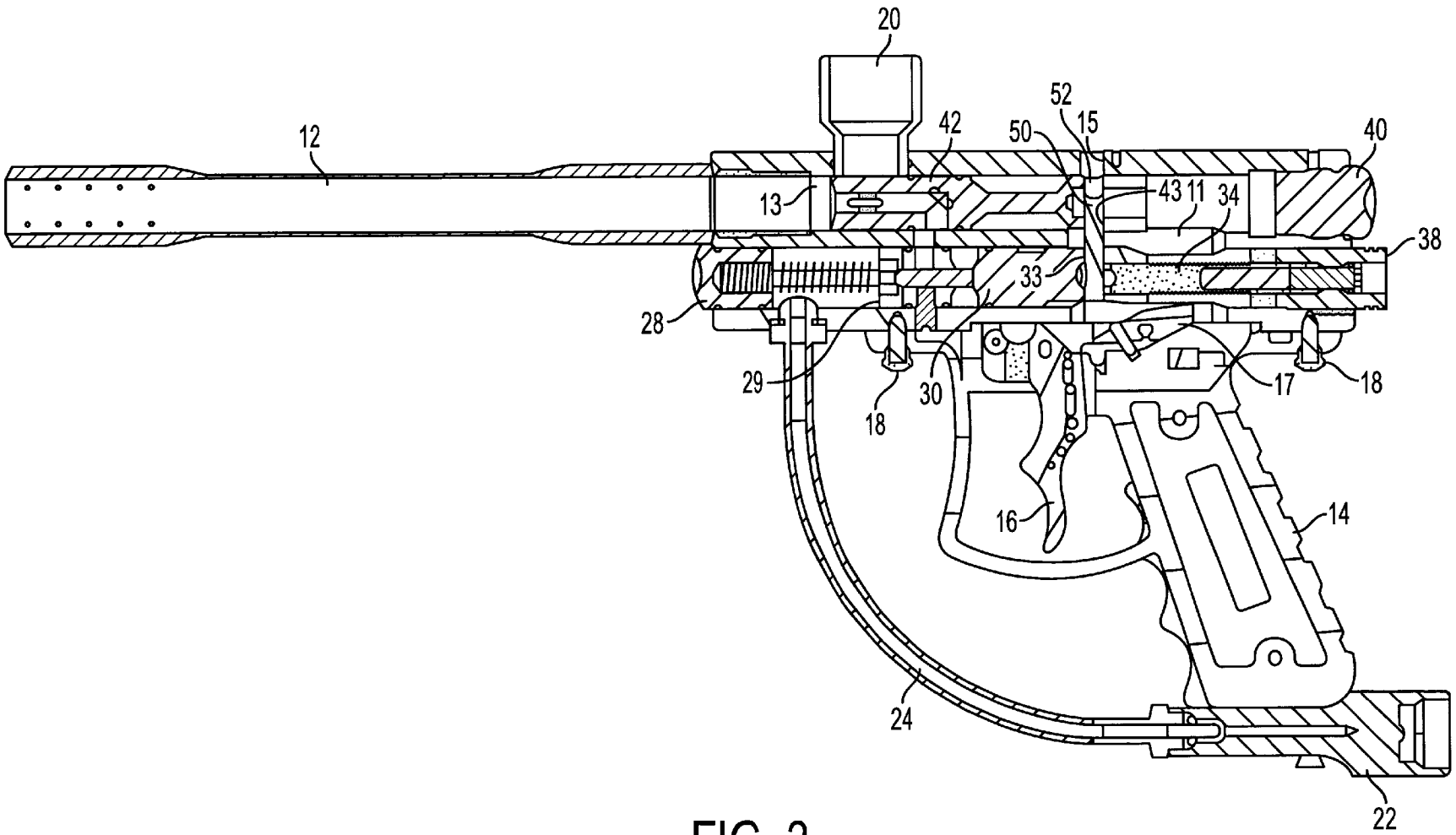
FIG. 2 is a longitudinal sectional view of the marker of FIG. 1.
Figure 3:
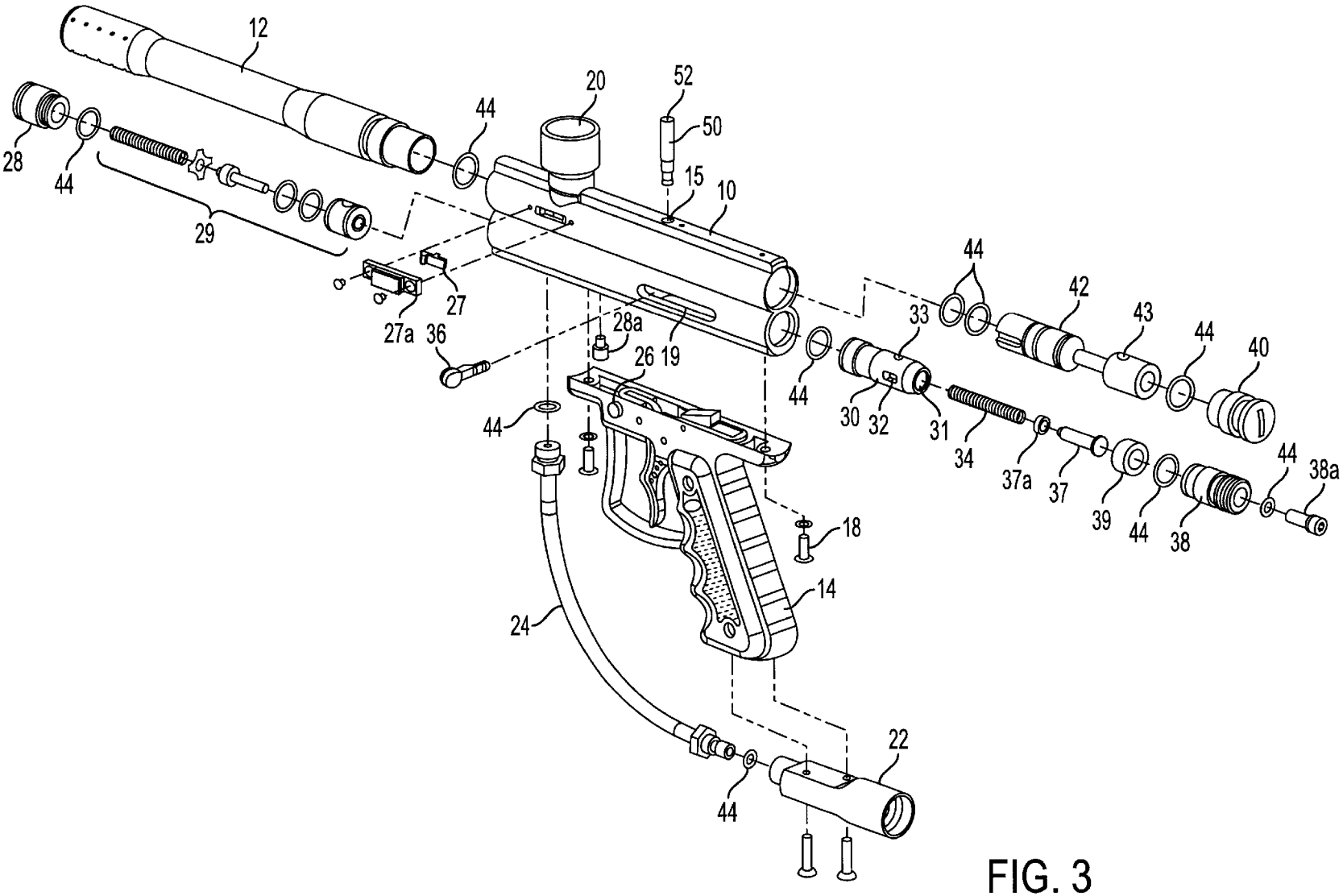
FIG. 3 is an exploded view of the marker of FIG. 1.
Figure 5:
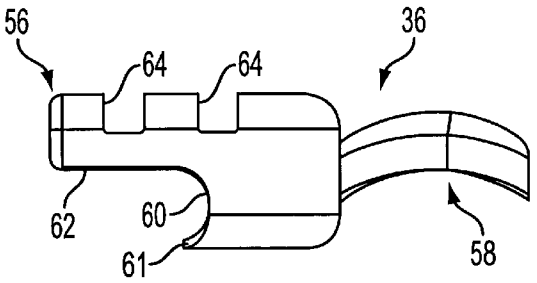
FIG. 5 is a top plan view of the cocking knob of FIG. 4.
Figure 8:
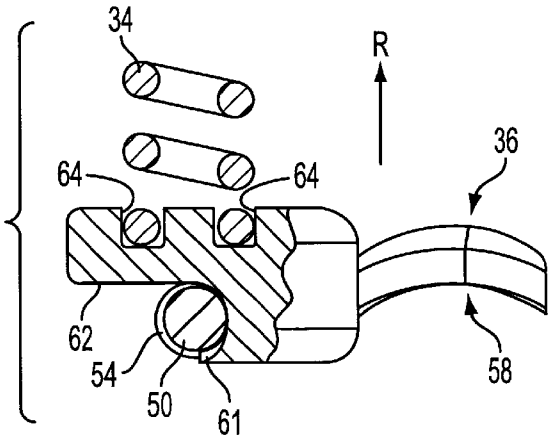
FIG. 8 is a top plan view of the cocking knob, partly in section, showing its engagement with the connecting pin and the striker spring.
Figure 7:
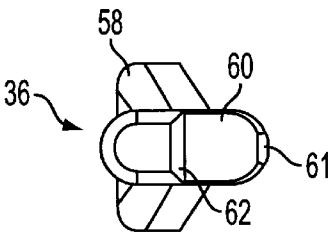
FIG. 7 is a proximal end view of the cocking knob of FIG. 4.
Figure 4:
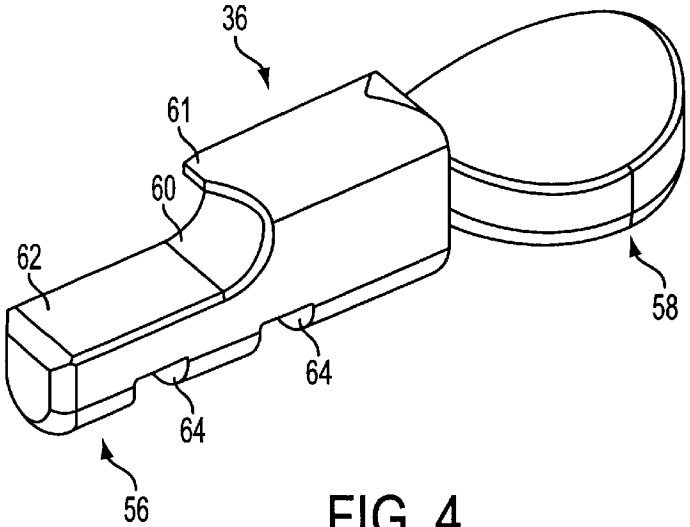
FIG. 4 is a perspective view of the cocking knob according to the invention as seen from the bottom and the rear.
Figure 6:
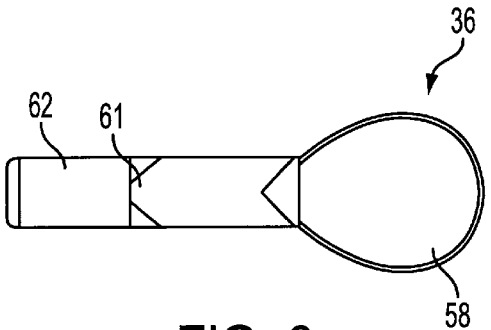
FIG. 6 is a front elevational view of the cocking knob of FIG. 4.

FIGS. 1–3 depict a paintball marker embodying the features of the invention with the moving parts shown in the uncocked position. The marker comprises a receiver 10; a barrel 12 threaded into the receiver ahead of a chamber 13; a grip assembly 14, with a trigger 16 and a sear 17, attached to the receiver by means of screws 18; a ball inlet 20 through which paintballs are fed (e.g., from a hopper); and an internally threaded adapter 22 for connection to a source of compressed $CO_2$ which is fed to the receiver through hose 24. A safety 26 cooperates with the trigger mechanism in a known manner to lock or unlock the trigger. A resilient ball stop 27, beneath cover 27*a*, keeps the paintball in chamber 13 from sliding out of barrel 12 before firing.

A valve plug 28 and valve set screw 28*a* retain a valve assembly 29 in receiver 10. To the rear of valve assembly 29 is a striker 30 which is urged forwardly by a striker spring 34 that extends into striker 30 through a rear bore 31. A cocking knob 36 operatively engages striker 30 through a lateral opening 32, and projects outwardly from the receiver through a slot 19. A striker plug 38 retains striker 30, striker spring 34, a spring guide 37, a spacer 37*a* and a bumper 39 in receiver 10. A velocity adjustment screw 38*a* is carried by striker plug 38. A bolt plug 40 seals off the back end of receiver 10 behind the bolt 42. Various O-rings 44 act as seals between mating parts, where needed.

A connecting pin 50 links together striker 30 and bolt 42 so that they move in unison. Specifically, connecting pin 50 extends through a vertical bore 43 in bolt 42, through an open vertical space 11 in receiver 10, and into a vertical bore 33 in striker 30. Thus, in a manner known in the art, forward movement of striker 30 upon firing will advance bolt 42 to move a paintball forwardly in chamber 13, whereupon it is propelled through barrel 12 by a burst of $CO_2$ fed through the bolt when the striker actuates valve assembly 29. Gas pressure then returns striker 30 to its cocked position, held to the rear against the force of striker spring 34 by sear 17. This brings bolt 42 back to its initial position, allowing the next paintball to fall through ball inlet 20 into firing position in chamber 13.

Connecting pin 50 is removable for disassembly through a hole 15 in the top of receiver 10. The connecting pin has a threaded bore 52 at its top end which allows a similarly threaded tool to engage and extract the connecting pin. For example, spring guide 37 may serve as such a tool when provided with a male thread at its forward end that mates with the female thread in connecting pin 50. A circumferential groove 54 near the bottom of connecting pin 50 cooperates with the proximal portion of cocking knob 36 as described below.

Referring to FIGS. 4–8, cocking knob 36 is a generally elongated member having a proximal portion 56 adapted to engage connecting pin 50, and an ergonomically configured distal portion 58 adapted for comfortable hand engagement when pulled rearwardly to cock the marker. Proximal portion 56 has a J-shaped recess 60, the curved portion of which closely fits into groove 54 in connecting pin 50 (see FIG. 8). Cocking knob 36 thus retains connecting pin 50 in striker 30 and bolt 42.

J-shaped recess 60 opens generally axially (i.e., lengthwise of the cocking knob) and forwardly (i.e., toward the front of the marker). The shorter leg 61 of the J extends sufficiently around connecting pin 50 to provide a shoulder which positively forces the connecting pin rearwardly (in the direction of arrow R in FIG. 8) when the cocking knob is pulled rearwardly to cock the marker. The longer leg 62 of the J lies to the rear of J-shaped recess 60 and has on its rear face a spring seat comprising a pair of spaced notches 64 forming a recess in which the forward end of striker spring 34 rests. Forward spring pressure against cocking knob 36 prevents disengagement of the cocking knob from connecting pin 50 because the striker spring 34 cooperates with the shoulders of notches 64 to prevent axial movement of the cocking knob (i.e., laterally of the marker).

During disassembly of the marker, in particular disassembly of the striker and the cocking knob, striker plug 38 is first removed to gain access to striker spring 34. Bumper 39, spring guide 37, spacer 37*a* and ultimately striker spring 34 are removed. With striker spring 34 disengaged from the spring seat (notches) 64, cocking knob 36 is easily pulled laterally out of receiver 10 and out of engagement with connecting pin 50. Disassembly of other parts of the marker, e.g. connecting pin 50, bolt 42, etc., can then be carried out in the conventional manner. Reassembly involves reversal of these steps. In either case, the lack of a threaded connection between cocking knob 36 and connecting pin 50 makes for a simpler, easier and faster procedure.

While a J-shaped recess 60 in cocking knob 36 is preferred, a recess of any suitable configuration may be used as long as it affords the required working engagement between the cocking knob and the connecting pin described above. For example, a generally V-shaped recess would appear to satisfy these criteria, and would allow for the advantageous simple disengagement and reengagement described above.

Further, while the seat for striker spring 34 preferably is formed by two spaced notches 64, any type of spring seat may be provided on the rear of cocking knob 36 as long as it adequately seats striker spring 34 and provides sufficient resistance to lateral withdrawal of cocking knob 36 when the striker spring is engaged therewith. For example, a simple flat-bottomed recess on the rear of the cocking knob would appear adequately to seat striker spring 34 and prevent withdrawal of cocking knob 36.

Still further, while the proximal portion of cocking knob 36 is disclosed as cooperating with a separate connecting pin 50, it is to be understood that the inventive concept disclosed herein is applicable to an arrangement wherein the cocking knob engages another element associated with the striker, whether it be integrally formed with the striker or separately formed and assembled therewith.

Various other modifications will be apparent to those skilled in the art without departing from the scope of the invention, which is defined by the appended claims.

What is claimed is:

1. A cocking knob for moving a striker of a gas-powered projectile firing device rearwardly into a cocked position ready for firing, the striker being biased forwardly by a striker spring, the cocking knob comprising an elongated member having a longitudinal axis, a proximal portion adapted for operative connection with the striker and a manually engageable distal portion, the proximal portion having a rearwardly facing spring seat adapted to engage the striker spring, wherein the striker spring has a front end, and the spring seat comprises a pair of spaced notches in which the front end of the striker spring can rest.

2. A cocking knob according to claim 1, wherein the proximal portion has a striker seat adapted to operatively engage the striker, the engagement of the striker spring and the spring seat serving to prevent disengagement of the striker seat from the striker.

3. A cocking knob according to claim 2, wherein the striker seat comprises a generally J-shaped recess defined in part by a longer leg having a front side and a rear side, the J-shaped recess opens generally axially and forwardly, and the spring seat is disposed on the rear side of the longer leg.

4. A cocking knob for moving a striker of a gas-powered projectile firing device rearwardly into a cocked position ready for firing, the striker being biased forwardly by a striker spring, the cocking knob comprising an elongated member having a longitudinal axis, a proximal portion adapted for operative connection with the striker and a manually engageable distal portion, the proximal portion having a rearwardly facing spring seat adapted to engage the striker spring, wherein the proximal portion has a striker seat adapted to operatively engage the striker, the engagement of the striker spring and the spring seat serving to prevent disengagement of the striker seat from the striker.

5. A cocking knob according to claim 4, wherein the striker spring has a front end, and the spring seat comprises a recess adapted to receive the front end of the striker spring.

6. A cocking knob according to claim 4, wherein the striker seat comprises a generally J-shaped recess defined in part by a longer leg having a front side and a rear side, the J-shaped recess opens generally axially and forwardly, and the spring seat is disposed on the rear side of the longer leg.

7. A gas-powered projectile firing device comprising a receiver, a striker slidable in the receiver, a striker spring biasing the striker forwardly, and a cocking knob for moving the striker rearwardly into a cocked position ready for firing; the cocking knob comprising an elongated member having a longitudinal axis, a proximal portion operatively connected with the striker and a manually engageable distal portion, the proximal portion having a rearwardly facing spring seat which engages the striker spring.

8. A gas-powered projectile firing device according to claim 7, wherein the striker spring has a front end, and the spring seat comprises a recess which receives the front end of the striker spring.

9. A gas-powered projectile firing device according to claim 8, wherein the spring seat recess comprises a pair of spaced notches in which the front end of the striker spring rests.

10. A gas-powered projectile firing device according to claim 9, wherein the proximal portion has a striker seat operatively engaging the striker, the engagement of the striker spring and the spring seat serving to prevent disengagement of the striker seat from the striker.

11. A gas-powered projectile firing device according to claim 10, wherein the striker seat comprises a generally J-shaped recess defined in part by a longer leg having a front side and a rear side, the J-shaped recess opens generally axially and forwardly, and the spring seat is disposed on the rear side of the longer leg.

12. A gas-powered projectile firing device according to claim 11, wherein a substantially upright pin is attached to the striker and is received in the J-shaped recess.

13. A gas-powered projectile firing device according to claim 8, wherein the proximal portion has a striker seat operatively engaging the striker, the engagement of the striker spring and the spring seat serving to prevent disengagement of the striker seat from the striker.

14. A gas-powered projectile firing device according to claim 13, wherein the striker seat comprises a generally J-shaped recess defined in part by a longer leg having a front side and a rear side, the J-shaped recess opens generally axially and forwardly, and the spring seat is disposed on the rear side of the longer leg.

15. A gas-powered projectile firing device according to claim 14, wherein a substantially upright pin is attached to the striker and is received in the J-shaped recess.

16. A gas-powered projectile firing device according to claim 7, wherein the proximal portion has a striker seat operatively engaging the striker, the engagement of the striker spring and the spring seat serving to prevent disengagement of the striker seat from the striker.

17. A gas-powered projectile firing device according to claim 16, wherein the striker seat comprises a generally J-shaped recess defined in part by a longer leg having a front side and a rear side, the J-shaped recess opens generally axially and forwardly, and the spring seat is disposed on the rear side of the longer leg.

18. A gas-powered projectile firing device according to claim 17, wherein a substantially upright pin is attached to the striker and is received in the J-shaped recess.

19. A gas-powered projectile firing device according to claim 7, wherein the striker has a rear end, an axial bore at the rear end and a lateral opening ahead of the rear end which opens into the axial bore, the proximal portion of the cocking knob extends through the lateral opening into the axial bore, and the striker spring extends forwardly into the axial bore to engage the spring seat on the proximal portion of the cocking knob.

20. A gas-powered projectile firing device according to claim 19, wherein the striker spring has a front end, and the spring seat comprises a recess which receives the front end of the striker spring.

21. A gas-powered projectile firing device according to claim 20, wherein the spring seat recess comprises a pair of spaced notches in which the front end of the striker spring rests.

22. A gas-powered projectile firing device according to claim 21, wherein the proximal portion has a striker seat operatively engaging the striker, the engagement of the striker spring and the spring seat serving to prevent disengagement of the striker seat from the striker.

23. A gas-powered projectile firing device according to claim 22, wherein the striker seat comprises a generally J-shaped recess defined in part by a longer leg having a front side and a rear side, the J-shaped recess opens generally axially and forwardly, and the spring seat is disposed on the rear side of the longer leg.

24. A gas-powered projectile firing device according to claim 19, wherein the striker has substantially upright bore which opens into the axial bore, and a connecting-pin in the upright bore which extends into the axial bore, the proximal portion of the cocking knob engaging the connecting pin.

25. A gas-powered projectile firing device according to claim 24, wherein the striker spring has a front end, and the spring seat comprises a recess which receives the front end of the striker spring.

26. A gas-powered projectile firing device according to claim 25, wherein the spring seat recess comprises a pair of spaced notches in which the front end of the striker spring rests.

27. A gas-powered projectile firing device according to claim 26, wherein the proximal portion has a striker seat operatively engaging the connecting pin, the engagement of the striker spring and the spring seat serving to prevent disengagement of the striker seat from the connecting pin.

28. A gas-powered projectile firing device according to claim 27, wherein the striker seat comprises a generally J-shaped recess defined in part by a longer leg having a front side and a rear side, the J-shaped recess opens generally axially and forwardly, and the spring seat is disposed on the rear side of the longer leg.

29. A gas-powered projectile firing device comprising:

a receiver having a front end;

a chamber in the receiver;

a bolt slidable in the chamber;

a barrel at the front end of the receiver aligned with the chamber;

a striker slidable in the receiver parallel to and below the chamber;

a connecting pin interconnecting the striker and the bolt so that they move in unison;

a valve assembly in the receiver forwardly of the striker;

a striker spring in the receiver having a front end and biasing the striker forwardly toward the valve assembly;

a sear and trigger assembly for controlling the motion of the striker; and a cocking knob for moving the striker rearwardly into a cocked position ready for firing, the cocking knob comprising an elongated member having a longitudinal axis, a proximal portion engaging the connecting pin and a manually engageable distal portion, the proximal portion having a rearwardly facing spring seat which engages the front end of the striker spring.

30. A gas-powered projectile firing device according to claim 29, wherein the striker has a rear end, an axial bore at the rear end thereof and a lateral opening ahead of the rear end which opens into the axial bore, the proximal portion of the cocking knob extends through the lateral opening into the axial bore, and the striker spring extends forwardly into the axial bore to engage the spring seat on the proximal portion of the cocking knob.

31. A gas-powered projectile firing device according to claim 30, wherein the spring seat comprises a recess which receives the front end of the striker spring.

32. A gas-powered projectile firing device according to claim 31, wherein the spring seat recess comprises a pair of spaced notches in which the front end of the striker spring rests.

33. A gas-powered projectile firing device according to claim 31, wherein the proximal portion has a striker seat operatively engaging the connecting pin, the engagement of the striker spring and the spring seat serving to prevent disengagement of the striker seat from the connecting pin.

34. A gas-powered projectile firing device according to claim 33, wherein the striker seat comprises a generally J-shaped recess defined in part by a longer leg having a front side and a rear side, the J-shaped recess opens generally axially and forwardly, and the spring seat is disposed on the rear side of the longer leg.

35. A gas-powered projectile firing device according to claim 30, wherein the connecting pin extends into the axial bore in the striker, the proximal portion of the cocking knob engaging the connecting pin in the axial bore.

36. A gas-powered projectile firing device according to claim 35, wherein the spring seat comprises a recess which receives the front end of the striker spring.

37. A gas-powered projectile firing device according to claim 36, wherein the spring seat recess comprises a pair of spaced notches in which the front end of the striker spring rests.

38. A gas-powered projectile firing device according to claim 37, wherein the proximal portion has a striker seat operatively engaging the connecting pin, the engagement of the striker spring and the spring seat serving to prevent disengagement of the striker seat from the connecting pin.

39. A gas-powered projectile firing device according to claim 38, wherein the striker seat comprises a generally J-shaped recess defined in part by a longer leg having a front side and a rear side, the J-shaped recess opens generally axially and forwardly, and the spring seat is disposed on the rear side of the longer leg.

* * * * *

UNITED STATES PATENT AND TRADEMARK OFFICE

CERTIFICATE OF CORRECTION

PATENT NO. : 6,658,982 B2
DATED : December 9, 2003
INVENTOR(S) : Cherry et al.

It is certified that error appears in the above-identified patent and that said Letters Patent is hereby corrected as shown below:

Title page,
Item [75], Inventor, please add:
-- Benjamin M. William --

Signed and Sealed this

Eighteenth Day of January, 2005

JON W. DUDAS
*Director of the United States Patent and Trademark Office*

UNITED STATES PATENT AND TRADEMARK OFFICE

CERTIFICATE OF CORRECTION

PATENT NO. : 6,658,982 B2
DATED : December 9, 2003
INVENTOR(S) : Cherry et al.

It is certified that error appears in the above-identified patent and that said Letters Patent is hereby corrected as shown below:

Title page,
Item [75], Inventor, please add:
-- Benjamin M. Williams, Midland, GA --

This certificate supersedes Certificate of Correction issued July 18, 2005.

Signed and Sealed this

Twenty-ninth Day of March, 2005

JON W. DUDAS
*Director of the United States Patent and Trademark Office*

UNITED STATES PATENT AND TRADEMARK OFFICE

CERTIFICATE OF CORRECTION

PATENT NO. : 6,658,982 B2
DATED : December 9, 2003
INVENTOR(S) : Cherry et al.

It is certified that error appears in the above-identified patent and that said Letters Patent is hereby corrected as shown below:

Title page,
Item [75], Inventor, please add:
-- Benjamin M. Williams, Midland, GA --.

This certificate supersedes Certificate of Correction issued January 18, 2005 and March 29, 2005.

Signed and Sealed this

Twenty-fifth Day of October, 2005

JON W. DUDAS
*Director of the United States Patent and Trademark Office*